US007051698B2

(12) United States Patent
Ollis

(10) Patent No.: US 7,051,698 B2
(45) Date of Patent: May 30, 2006

(54) ROTARY DRIVE MECHANISM

(76) Inventor: William Henry Ollis, 6A Church End Haddenham, Bucks (GB), HP17 8AH ( * ) Notice: Subject to any disclaimer, the term of this patent is extended or adjusted under 35 U.S.C. 154(b) by 0 days.

(21) Appl. No.: 10/399,357

(22) PCT Filed: Oct. 16, 2001

(86) PCT No.: PCT/GB01/04595

§ 371 (c)(1),
(2), (4) Date: Nov. 3, 2003

(87) PCT Pub. No.: WO02/33222

PCT Pub. Date: Apr. 25, 2002

(65) Prior Publication Data

US 2004/0088981 A1 May 13, 2004

(30) Foreign Application Priority Data

Oct. 16, 2000 (GB) ..... 00252734
Apr. 17, 2001 (GB) ..... 01093459

(51) Int. Cl.
*F02B 53/00* (2006.01)

(52) U.S. Cl. ..... 123/241; 123/200

(58) Field of Classification Search ..... 123/200, 123/241; 418/112, 113, 119
See application file for complete search history.

(56) References Cited

U.S. PATENT DOCUMENTS 3,825,375 A 7/1974 Deane
3,873,245 A 3/1975 Doshi
3,887,307 A 6/1975 Pratt
3,923,430 A * 12/1975 Huf ..... 418/60
4,008,988 A 2/1977 Putz
4,395,206 A * 7/1983 Hoffmann ..... 418/61.2
5,131,270 A 7/1992 Lew
5,259,739 A * 11/1993 Coates et al. ..... 418/1
5,380,177 A 1/1995 Leroy et al.
5,393,208 A * 2/1995 Sbarounis ..... 418/54

FOREIGN PATENT DOCUMENTS

| | | |
|---|---|---|
| DE | 2647150 | 4/1978 |
| DE | 29520290 | 12/1996 |
| DE | 19920289 | 7/2000 |
| FR | 2777943 | 10/1999 |

* cited by examiner

*Primary Examiner*—Hoang Nguyen
(74) *Attorney, Agent, or Firm*—Pollack, P.C.; Grant E. Pollack

(57) ABSTRACT

A rotary drive mechanism for use as a motor, pump or compressor. The mechanism includes a housing having a chamber defined by a peripheral wall. A rotor is rotatably mounted in the chamber and has two longitudinal seal edges in contact with the wall. The rotor is mounted for rotation about a rotation axis and for sliding movement relative to the axis in a direction generally perpendicular thereto. The axis is offset from the center of the chamber.

17 Claims, 11 Drawing Sheets

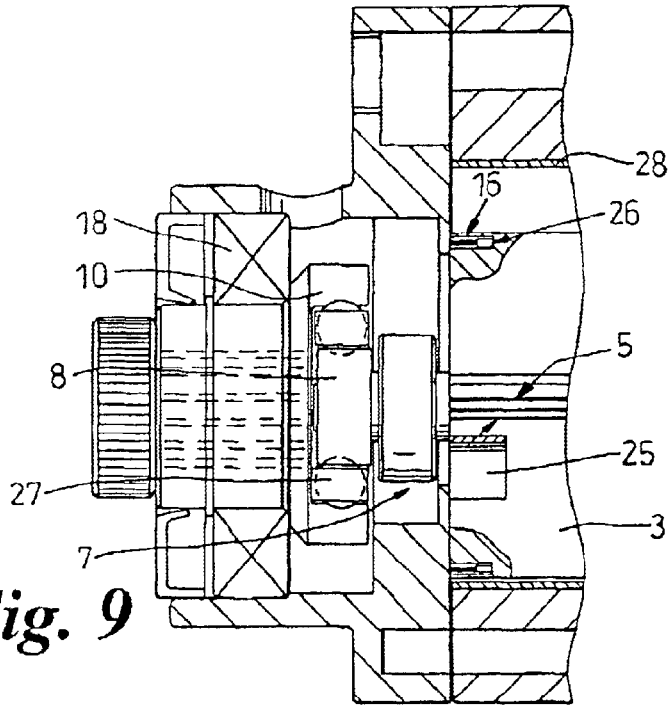
Fig. 9
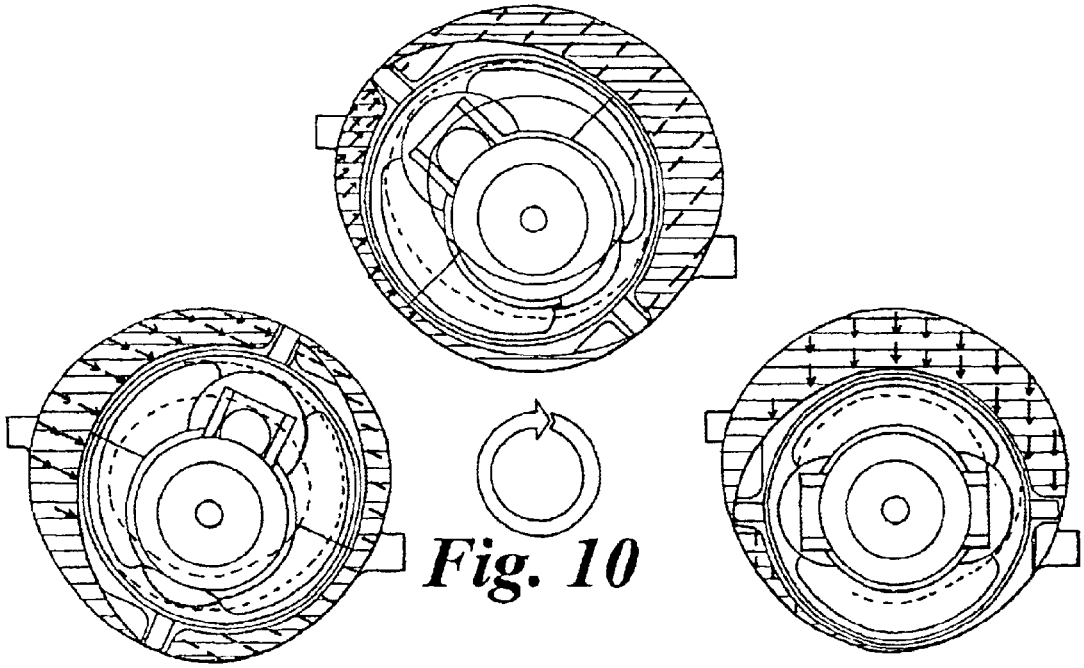
Fig. 10
Fig. 10A
Fig. 10B

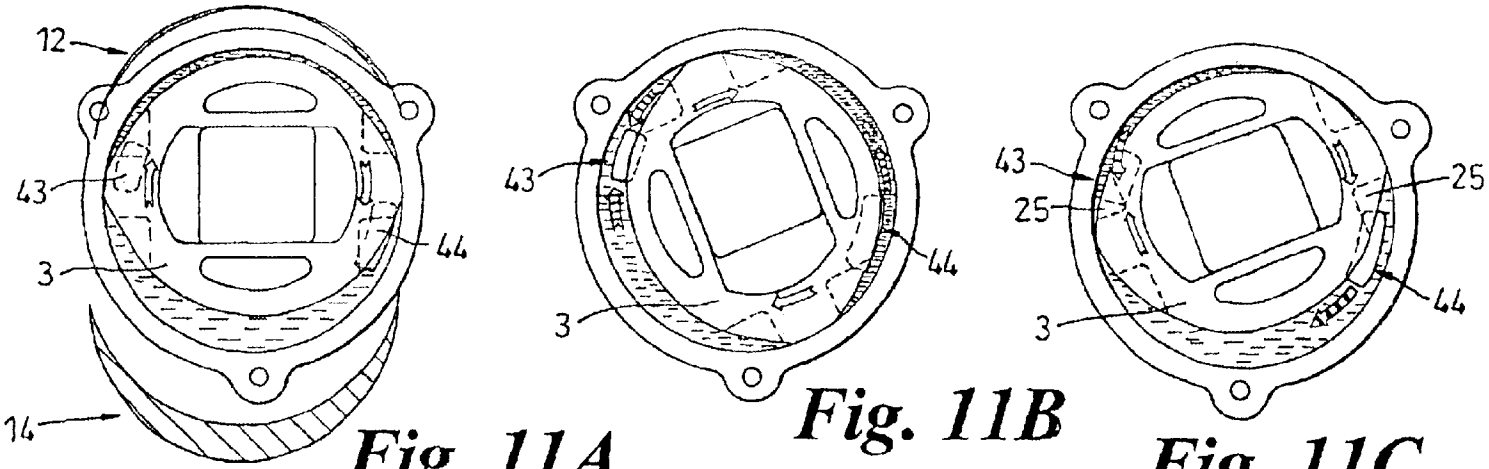
Fig. 11A
Fig. 11B
Fig. 11C
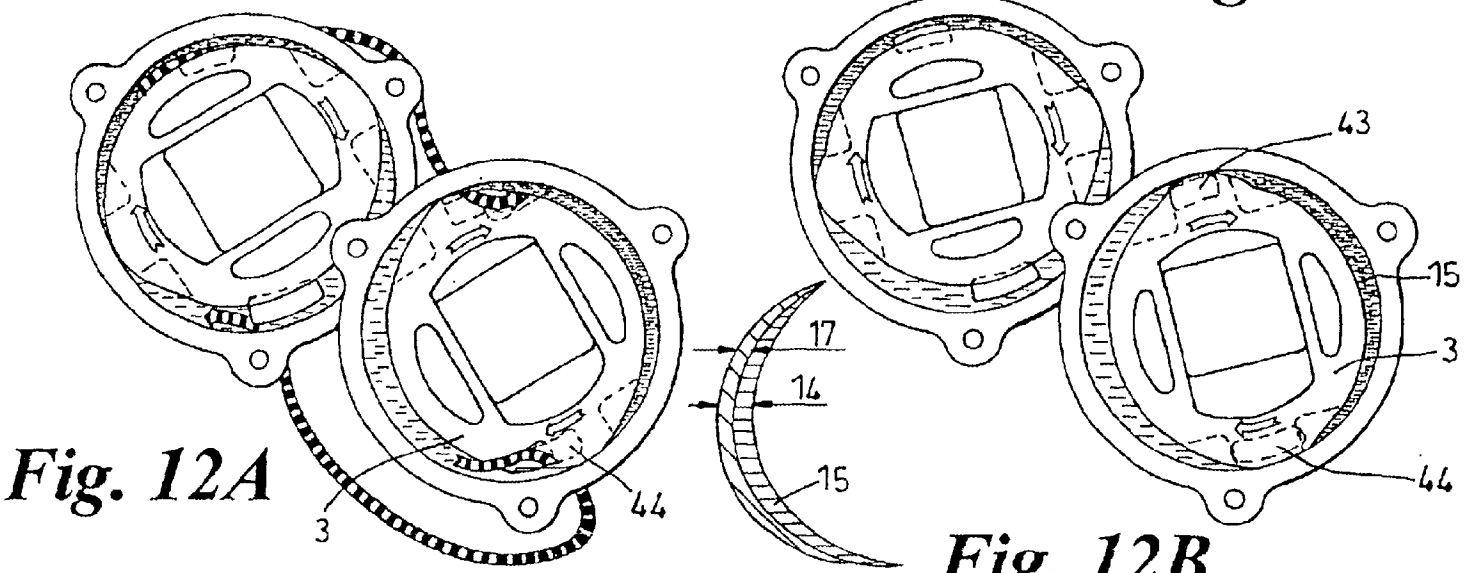
Fig. 12A
Fig. 12B

ROTARY DRIVE MECHANISM

FIELD OF THE INVENTION

The present invention relates generally to motors, pumps, compressors or the like and, more particularly, to a drive system and displacement geometry for use with the same.

BACKGROUND OF THE INVENTION

Generally speaking, there are two main types of rotary engine geometries that operate within a chamber. Perhaps the simplest form is an arrangement of one or more radially projecting vanes which slide in and out or through a slotted hub on a displaced center within a circular or non-circular chamber. Vane movement is usually considerable as are the lubrication requirements, in the context of air compressor applications. While the lubrication requirements often become a nuisance, such are not insurmountable.

Another form of rotary displacement pump/motor utilizes a rotor with two, three or even four active rotor sides, the rotor orbiting and gyrating upon a reduced diameter toothed shaft. Possibly the best-known example of such rotary geometry is an internal combustion engine generally referred to as a Wankel engine. This engine operates using a triangular rotor gyrating around a figure eight-like chamber periphery. The rotor meshes onto a hollow, externally toothed shaft, a toothed bore of the rotor having a diameter significantly greater than that of the shaft. This toothed gearing operates to thrust the rotor to hoop around the shaft in a gyrating cycle within the chamber geometry. The movement causes live volume displacement between any two rotor tip faces on each of the three rotor sides. This, in turn, creates the four cycles of internal combustion at set arcs around the chamber. While useful, the motion of the rotor often causes undue wear on the rotor tips resulting in limited life. Even with this drawback and associated fuel port bypass problems, however, the Wankel engine creates enormous compact power.

At the turn of the century, a number of attempts were made to incorporate a similar chamber profile into a pump/engine. Although these arrangements were useful, the rotary component was found fundamentally flawed. In particular, the rotary component comprised a single sliding vane that slides through a rotating boss or shaft. Such arrangements, by their nature, had no facility to provide an outwardly radial seal, and required that inoperable amounts of lubricant be exposed to the chamber in order to lubricate the sliding action.

Variable delivery arrangements such as an oil pump provide a means for adjusting and controlling delivery to match engine requirements, thus improving the overall energy efficiency in engines. In general, engines require a significantly (up to about 60%) lower linear output of oil delivery per engine rotation cycle at high speed than they do at low speed. As engine speed increases therefore the oil delivery rate per engine rotation cycle must be reduced proportionately in order to balance oil flow rates to specific engine requirements.

In addition, there is a distinct imbalance between the performance of conventional gear profiled oil pumps and precise engine requirements, especially at higher speeds when pump output increases and delivery requirements per engine cycle diminish. Accordingly, excessive oil flow frequently results at high engine speeds, this excess being typically released into the sump causing significant turbulence, mist and foaming within the lower engine sector.

Such excessive delivery output causes a situation by which conventional oil pump arrangements can absorb up to as much as about 4% of the engine's total power output.

The main drawbacks of existing vehicles are essentially that internal combustion engines are only around 20% efficient and electric battery vehicles are excessively heavy. Electricity is clean, and the energy prices, at off-peak are around one seventh that of petrol. Potentially, however, there are more immediate prospects of increasing efficiency of conventional vehicles by switching to external combustion. Internal combustion engines have to expel large amounts of heat energy, whereas external combustion engines actually utilize this heat. By combining this approach with a heat cell the main fuel could be pre-charged electrical heat, and there would be associated environmental benefits. The weight of a heat cell to achieve a ninety-mile range at fourteen horsepower (10kw) would be only about 200kg. The extra weight is considered inconsequential when compared to the enormous fuel cost savings and environmental benefits. Electric battery powered vehicles typically carry over 500kg of battery for half this range. Heat cell power to weight ratios would provide performance characteristics comparable to petrol vehicles. Such vehicles could be pre-charged overnight with pre-required energy levels to further maximize the efficiency of the following day's travel. It would be possible to achieve a match in conventional vehicle weights and still retain a 100kg heat cell by virtue of the reduced engine plant weight. This would create a dual fuel vehicle capable of short runs of 40 miles plus that are electric heat driven and longer runs using external combustion fueling.

With respect to the viability of the heat cell powered vehicle, detailed calculations reveal the following: while conventional re-chargeable vehicle batteries hold only about 0.01765kw hours of energy per kg, magnetite heat cells at 800° C. store about 0.149kw hours per kg. This represents an 8.4 fold benefit by weight. A 200kg heat cell would provide a vehicle range of about 90 miles at 14 horsepower (10 kw). Heat engine performance characteristics would be comparable to those of petrol vehicles. Also, heat cells have an indefinite life expectancy when compared with vehicle batteries. Fuel running costs using off-peak electricity would be 1/7th that of current petrol pricing, for instance, in the United Kingdom. In addition, a 90 mile heat cell (200 kg) would measure 450mm×450mm×450mm, or the size of a portable television (16"×16"×16") including the casing and insulation. The heat energy retained would be about 92.7% over 18 hours and approximately 71% over 72 hours. This assumes the worse energy loss (efficiency) case scenario of a fully charged heat cell where there is no positive energy extraction within the period.

OBJECTS AND SUMMARY OF THE INVENTION

It is, therefore, an object of the present invention to provide a rotary motor/pump having a novel but simple geometry that both seals and moves in an efficient manner.

Another object of the present invention is to provide a novel rotary geometry having applications in fluid or gas as a pump, compressor or motor as well as in heat or internal combustion engines.

A further object of the present invention is to provide a rotor geometry that overcomes drawbacks of existing rotary designs; namely, their excessive oil requirements and rotor wear on the seals.

Still another object of the present invention is to provide a rotary device that allows sealing characteristics equivalent to those of piston rings, while offering all the benefits of rotary motion.

Yet another object of the present invention is to provide a novel rotary device that is suitable for motor vehicle applications and associated environmental concerns.

A further object of the present invention is to provide a rotary device that is suitable for use in heat engine systems, namely, induction and heat expansion of an air/gas mix, such as power generating gas turbines.

Still a further object of the present invention is to provide a rotary geometry with a chamber profile that can provide smooth acceleration of rotor motion, as well as motion that can be manipulated to deliver optimum rotor lever arm characteristics dedicated to extract maximum power efficiently.

Another object of the present invention is to provide a rotary drive mechanism having its lubrication and sliding components enclosed internally within the rotor itself.

Yet a further object of the present invention is to provide a rotary device that retains a smooth operating motion through a stable axis.

Still another object of the present invention is to achieve reduced motion and travel through enhanced rotor enlargement.

A further object of the present invention is to provide a rotary motor, pump or compressor with a geometry capable of delivering compression ratios of about 21 up to about 15:1, while providing an optimum smooth rate of rotary motion.

Yet another object of the present invention is to solve the problem of the inefficiencies of excess delivery by incorporating port manipulation.

Another object of the present invention is to provide a rotary drive mechanism with an efficiency comparable to, if not potentially much greater than, that of conventional engines.

Still another object of the present invention is to provide a more practical, versatile and powerful approach to that of alternative fuel cell technology, as well as a device that lends itself to operation using any fuel source that delivers heat energy.

According to one aspect of the present invention, there is provided a rotary displacement geometry for use as a motor, pump or compressor, in which the simple motion of a two sided rotor sliding through a displaced axial center creates compression ratios of between about two and about fifteen to one, at maximum displacement, the chamber profile being a loop which could be circular, partially circular or fully noncircular, in each case the profile being contacted by either the two longitudinal rotor edges or seals mounted thereupon, the axially displaced center being offset from the actual mid-center by less than about one-sixth of the chambers effective internal diameter, and the rotor's circumscribed full cross sectional area being about 30% more of the chambers full cross sectional area.

In accordance with another aspect of the present invention, there is provided a rotary drive mechanism for use as a motor, a pump or a compressor, the mechanism including a housing having a chamber defined by a peripheral wall, a rotor rotatably mounted in the chamber having two longitudinal seal edges that contact a profiled wall, the rotor being mounted for rotation about a rotation axis and for sliding movement relative to the rotation axis in a direction generally perpendicular thereto, the rotation axis being offset from the actual midway center of the chamber.

According to a further aspect of the present invention, a variable delivery pump mechanism is provided that includes a housing having a chamber therein defined by a peripheral wall, a rotatable rotor mounted in the chamber and dividing the chamber into a plurality of sub-chambers, the rotor being constructed and arranged such that rotation thereof causes the volume of the sub-chambers to increase and decrease alternately, and an inlet/outlet port member having at least one inlet port and at least one outlet port therein, the inlet/outlet port member being rotatably adjustable relative to the housing, to adjust the delivery volume of the pump.

BRIEF DESCRIPTION OF THE DRAWINGS

The present invention will now be further described by reference to the following drawings which are not intended to limit the accompanying claims.

FIG. 9 is a side sectional view of the arrangements set forth in FIGS. 2 and 3 illustrating details of an end cap and bearing, in accordance with the present invention;

FIGS. 10–10B illustrate action of the rotor driven under pressure;

FIGS. 11A–11C show three stages of the displacement cycle of a simple scotch crank slide rotor pump/compressor;

FIGS. 12A and 12B show the effect of rotationally retarding the ports on volume delivery/real displacement and the flow effect on a double-banked rotor arrangement;

The same numerals are used throughout the drawing figures to designate similar elements. Still other objects and advantages of the present invention will become apparent from the following description of the preferred embodiments.

DETAILED DESCRIPTION OF THE PREFERRED EMBODIMENTS

Figure 1:
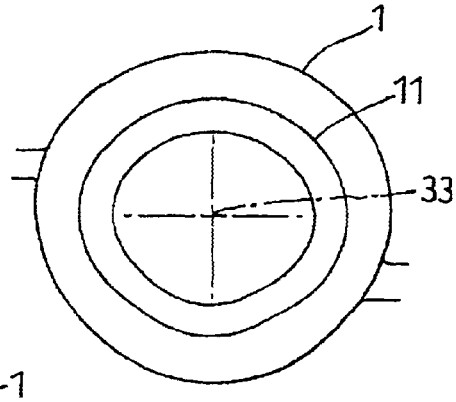
FIG. 1 shows a rotary drive chamber profile and roller track, according to one aspect of the present invention.
Figure 1A:
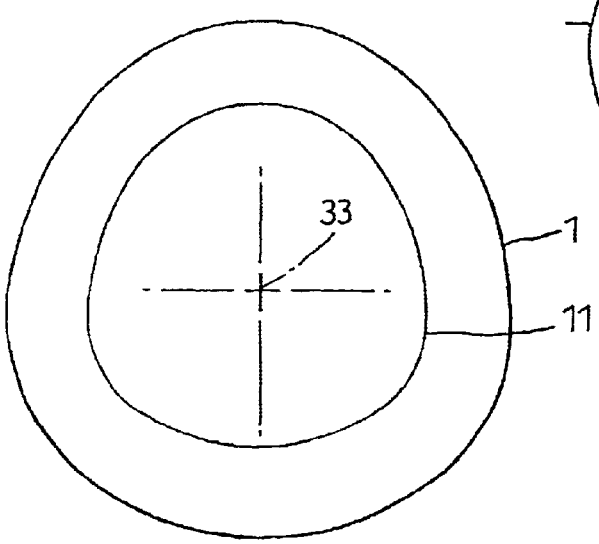
FIG. 1*a* is an alternative embodiment of the chamber profile and roller track shown in FIG. 1.

Referring now to the drawings and, more particularly, to FIGS. 1–22, there is shown generally a specific, illustrative rotary drive mechanism for motors, pumps, compressors or like mechanisms, in accordance with various aspects of the present invention. According to one embodiment, as shown FIG. 1 a chamber profile or displacement chamber 1 and inwardly reduced bearing track 11 are provided for enabling a rotor 3, as shown in FIG. 3, to rotate within the displacement chamber, the bearing track setting the contact distance between the rotor tips and the chamber with a parabolic configuration. The midway center emphasizes the extent of displacement upon the active center immediately below. According to an alternative embodiment, illustrated generally in FIG. 1A, another chamber profile 1 is provided, such profile format being used preferably as a pump/compressor similar to that of FIG. 1.

Figure 2:
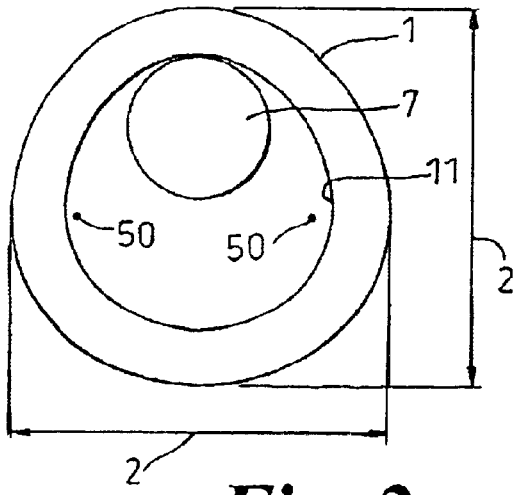
FIG. 2 illustrates a method of constructing one type of chamber profile and a rotor roller in contact with the bearing track.
Figure 3:
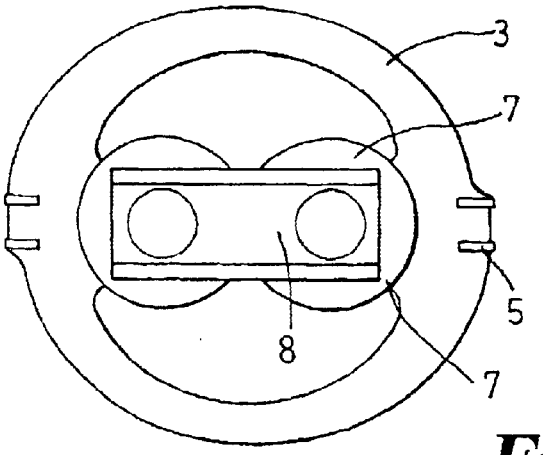
FIG. 3 shows a rotor assembly with slide bars and rollers connected, and a slide boss to the right.
Figure 3:
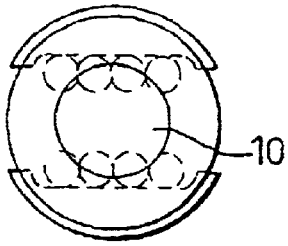

FIG. 2 shows how the unique chamber profile provides a relatively accurate and equal distance 2 at any point of rotation. The unique chamber geometry desirably takes the form of an exact ellipse below the center line construction around locus points 50, the upper profile above the center line being an ellipse defined by tracking chamber width distance 2 through the displaced center. A roller bearing 7 can be seen at a set distance from the chamber profile, running on an internal peripheral track 11. FIG. 2 also demonstrates how the roller track can be machined by a simple jig carrying a milling tool of exact corresponding roller bearing 7 diameter, held at an exact center distance to machine profile of reduced proportion to the chamber, to create a rotor roller control gap with the chamber. This allows the rotor to rotate without coming into contact with the chamber.

Figure 4:
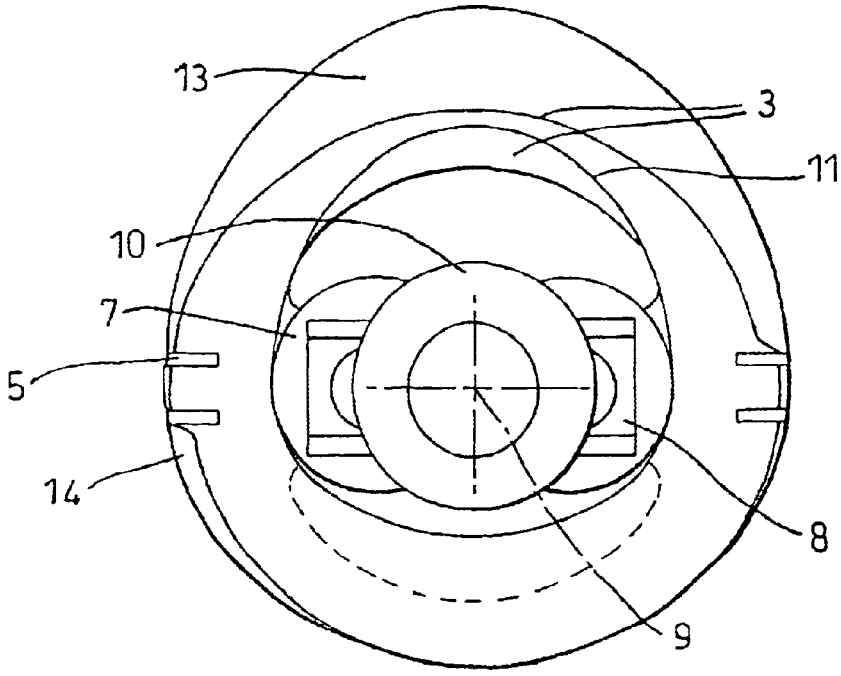
FIG. 4 shows a rotor assembly with the bearing assembly in place and the possible extent of compression displacement.

Components of rotor 3 assembly comprise rotor 3, the motion governing roller bearing 7, slide bar 8 and slide boss 10 that together permit sliding travel through the displaced center, hence restraining gyrational loadings. The rotor assembly components are illustrated, for instance, in FIG. 3. As shown in FIG. 4, the rotor assembly is engaged via roller bearings 7 within roller track 11 with the slide boss in its axially displaced center/position 9 engaged over the slide bar with seals 5 contacting the chamber and, thus, retaining a gap with the rotor tips.

Figure 4A:
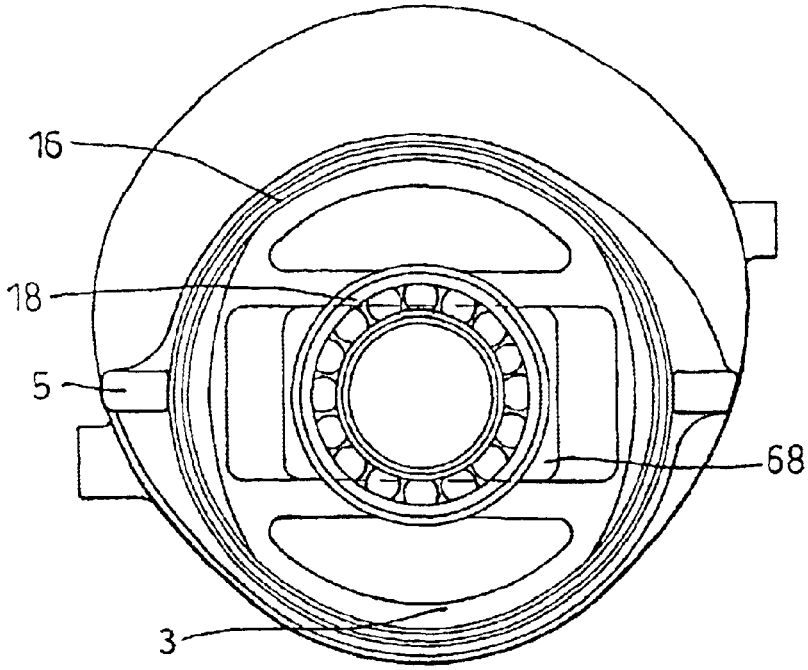
FIG. 4*a* shows a basic rotor assembly that rotates on a shaft, the motion of the rotor being that of a scotch crank.

Turning now to FIG. 4A, there is shown generally a basic form of the rotary device, where the rotor simply slides on a flat shaft 68 set into a main bearing 18 at either end on the displaced center. The flat shaft is preferably housed in a void within rotor 3. The edge seals may be seen in contact with end seal 16 which applies pressure generally outwardly to the edge seals.

Figure 5:
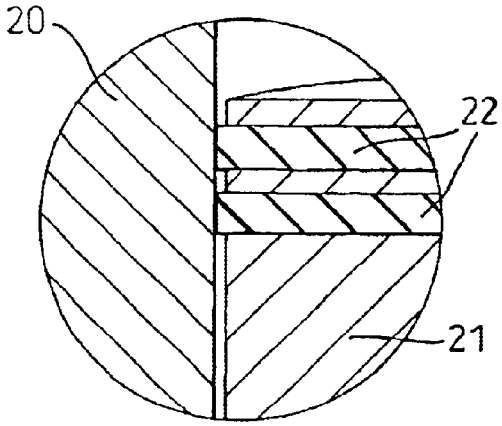
FIGS. 5–8D show alternative embodiments of the edge seal and contact angles in comparison to proven piston rings.

FIG. 5 shows a conventional piston 21 cylinder 20 arrangement with the effective sealing action of piston rings 22. It can be seen and appreciated elsewhere that the rotor edge seals act in an equally efficient manner, thereby retaining all of the benefits of rotary non-reciprocating motion.

Figure 6:
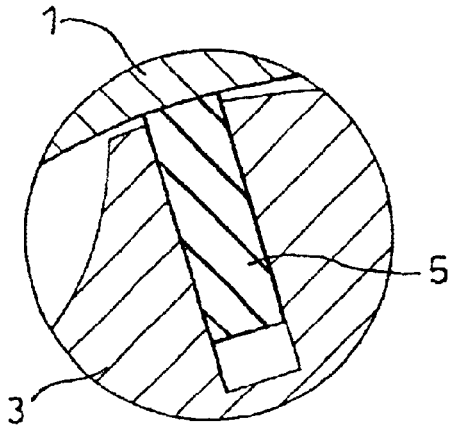
Figure 7:
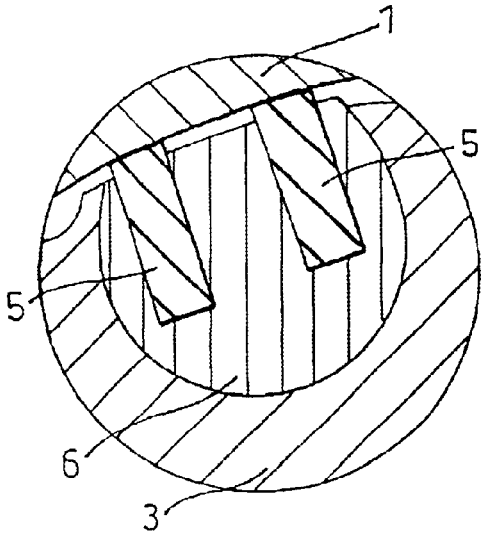
Figure 8:
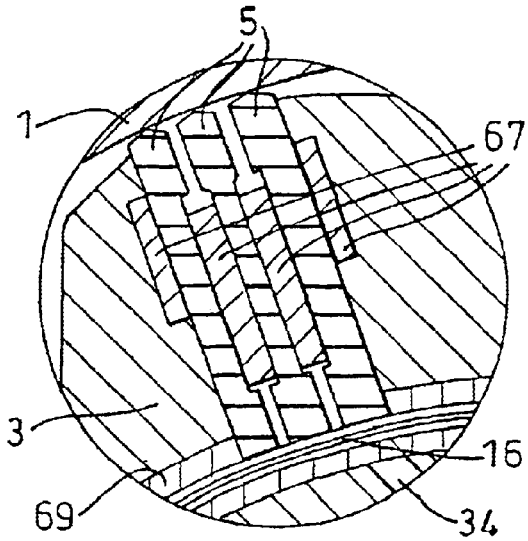

According to one embodiment of the present invention, a single seal 5 is applied which, other than slight spring pressure, effectively floats much the same way as piston ring 22 of FIG. 5. An arrangement of this general description is illustrated in FIG. 6. To this end, a relatively small gap is preferably maintained between the rotor and the chamber, the edge seals desirably benefitting from self-mass centrifugal forces. Alternatively, twin seals 5 may be applied, as shown in FIG. 7, if necessary. Specifically, the seals may be cradled in a generally spherical rocker 6 to further reduce seal movement. Adequate sealing is also achieved between the rotor and chamber with nominal seal movement, for example, when the spherical rocker floats on a film of oil pressured by centrifugal force. Further in the alternative, an arrangement is provided by which three seals 5 are set in seal bushes 67 so as to allow them to freely contact the chamber under the light outward pressure of end seal's 16 movement within a slackened seal recess 69. The recess is advantageously lubricated by the rotor which has a relatively small oil port 34 feeding edge and end seals 5 and 16. A representative three seal arrangement is shown in FIG. 8.

Figure 8A:
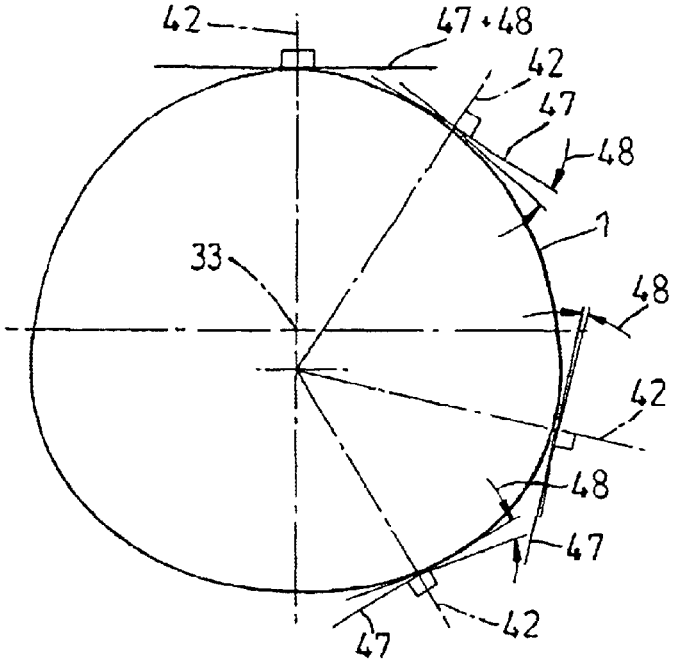

FIG. 8A shows the tangential angle 48 effect of edge seal 5 surface contact upon the chamber wall. Specifically, the relatively small change in tangential angle 48 is shown in comparision to optimum right angle 47. The line upon which the right angle line of angle 47 is drawn from the rotor axis line 42 at four points around chamber 1 on the right hand side. As indicated, the uppermost tangent line of angle 48 sits at the optimum zero to the perpendicular line 47 and the same occurs opposite the bottom end.

Figure 8B:
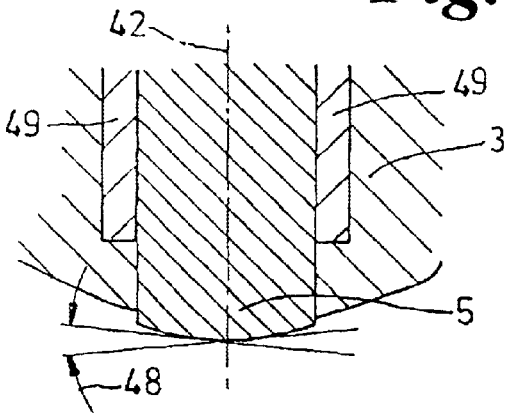
Figure 8C:
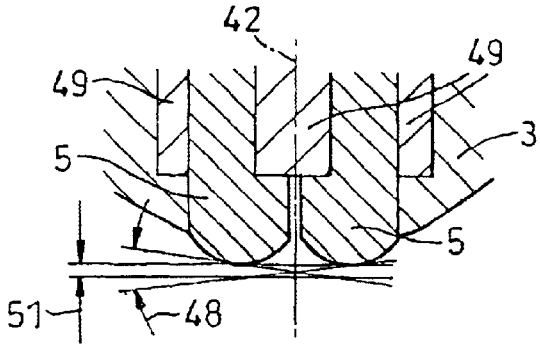
Figure 8D:
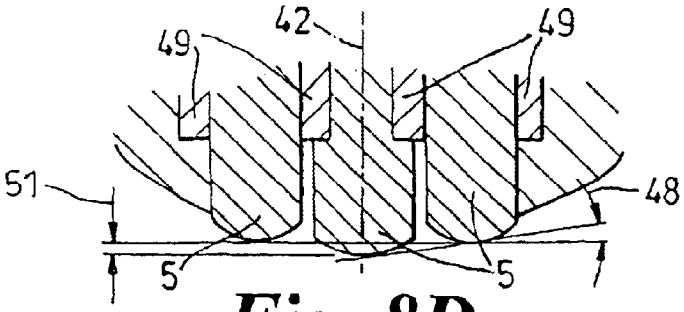

More particularly, as indicated in FIG. 8B, a single edge seal 5 arrangement, bushed 49 on both sides, is shown as well as the capacity of such arrangement to accommodate the tangential angle change through the radiusing edge seals. Alternatively or concurrently, a dual edge seal 5 arrangement is provided, also set in bushes 49, with the capacity to accomodate a fluctuating travel distance 51 that is marginal. Such a dual edge seal arrangement is illustrated in FIG. 8C. Further in the alternative, or concurrently therewith, a triple bank of edge seals 5 is utilized in a similar fashion (see FIG. 8D), the fluctuating travel distance being marginal but somewhat greater.

In addition, an end cap assembly is desirably provided which allows rotor 3 to rotate in a controlled manner. End seal 16 includes a ring spring 26 that forces the end seal into contact, sealing the end cap face. As best seen in FIG. 9, the roller ball bearings can be seen acting between slide boss 10 and slide bar 8 the exhaust recess bypass 25 on the lower portion of the rotor. FIGS. 10–10B show how the pressure motivates the rotor, the pressure being shown as broad arrows and the exhausting pressure being indicated as broad dashes.

Referring now to FIGS. 11A–11C, a simple scotch crank rotor 3 is shown running through a movement displacement cycle. Maximum displacement occurs generally between the upper and lower volumes (see FIG. 11A), these volumes being the minimum swept volume 12 and maximum swept volume 14, respectively. Outlet ports 43 and 44 are set in their prone position with maximum counter rotation set to maximum delivery. FIG. 11B shows the rotor inducting through inlet port 44 and expelling through outlet port 43. As the cycle nears the 180° rotational side switchover, rotor port recess 25 comes into effect, allowing the remaining fluid/gas to be expelled through the outlet port. This portion of the cycle is indicated generally in FIG. 11C.

FIGS. 12A and 12B show both how the variable delivery port 43, 44 plate pump/compressor, when double banked, can deliver non-fluctuating flow and how the delivery can be substantially reduced by rotational port retardation. More particularly, the upper volume of the left hand upper bank rotary arrangement expels into the inducting right hand side of the lower right rotary bank arrangement and vice versa, sympathetically annulling any fluctuation between banks. This feature is demonstrated in FIG. 12A. Ports 43, 44, it is noted, are shown in their fully retarded position for providing minimum delivery. As for the reduction of volume delivery, FIG. 12B illustrates this by overlaying retarded maximum swept volume 15 over the otherwise maximum swept volume 14, thereby revealing the net delivered swept volume 17. This is less than half, on a relatively small rotational retardation, of the ports of around 60°.

Figure 13:
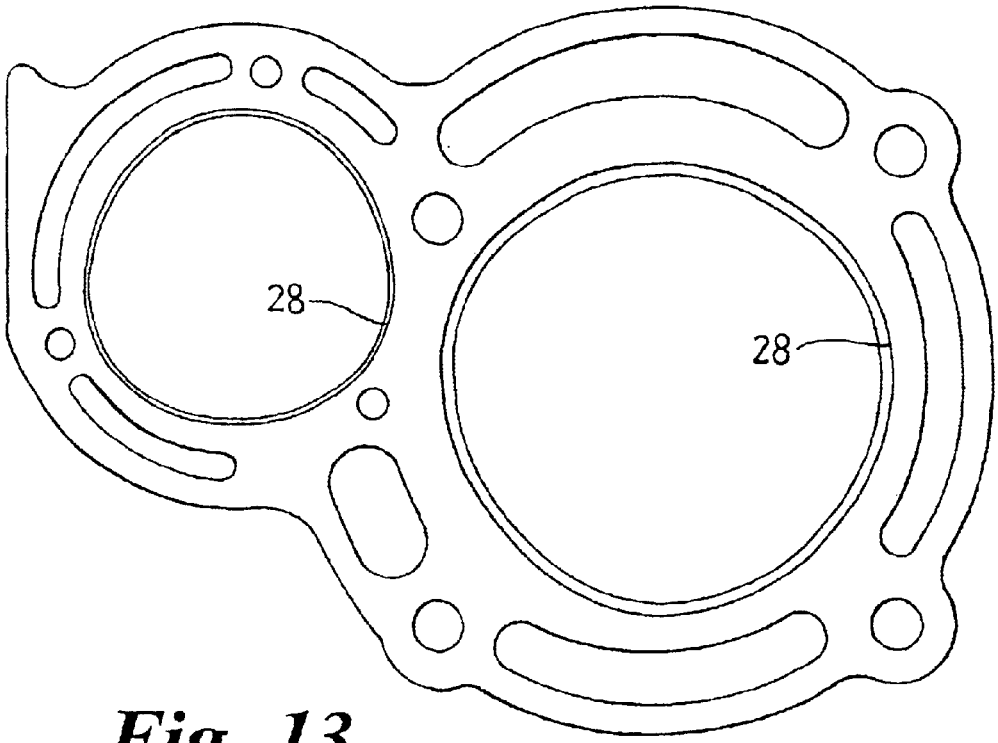
FIG. 13 illustrates a dual rotor chamber, according to one aspect of the present invention.
Figure 14:
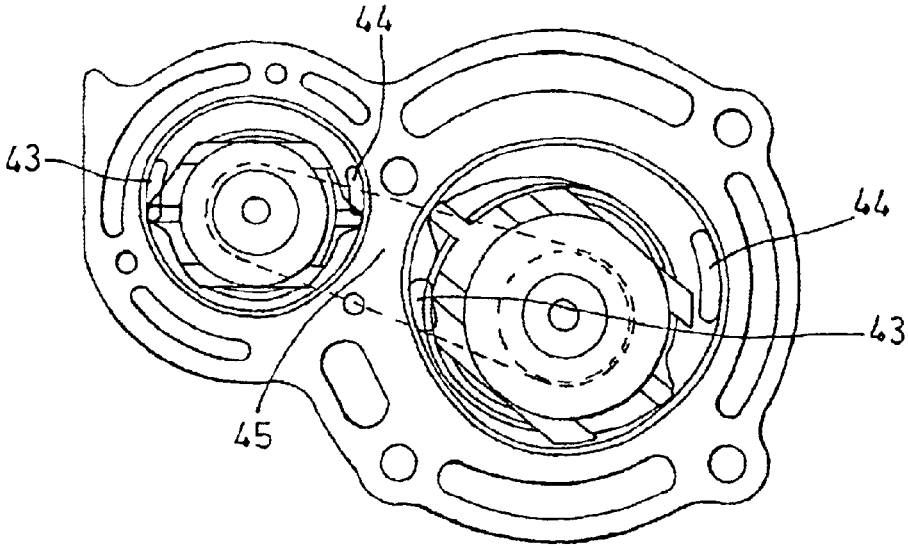
FIG. 14 shows a dual rotor arrangement for use as a double expansion hot gas or vapor engine and port arrangements.
Figures 15, 15A, 15B, 15C, 15D, 15E, 15F, 15G, 15H:
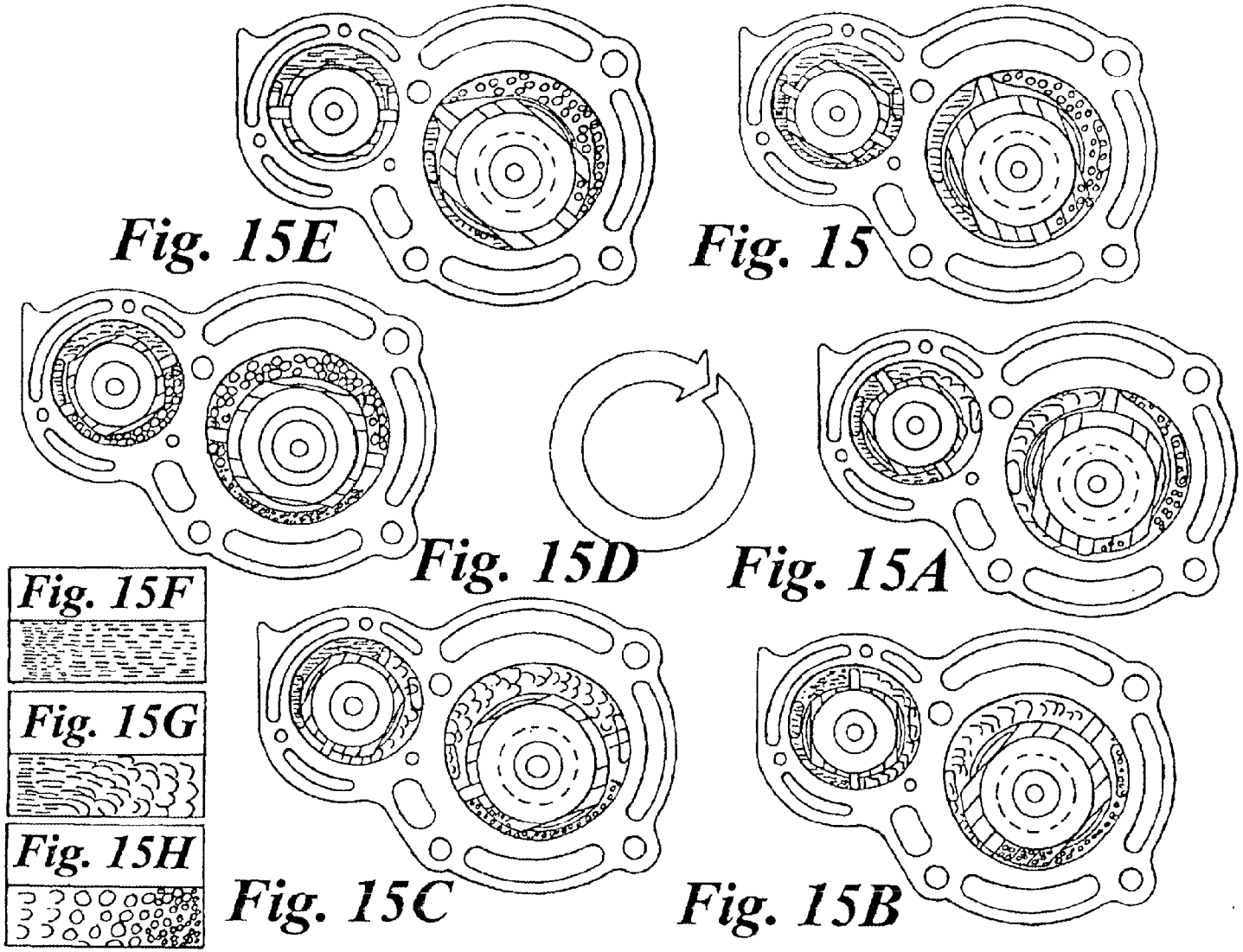
FIGS. 15–15H illustrate collectively a double expansion rotor cycle.

According to yet another embodiment of the present invention, a dual rotor extrusion is fitted with steel liners 28, as illustrated generally in FIG. 13. A further, albeit similar, embodiment, set forth in FIG. 14, finds particular application to a dual expansion hot gas, air or vapor rotor 3. Pursuant to this arrangement, an exhaust port 44, inlet ports 43 and a pressure feed link portal 45 are detailed in the drawing figure. Beneficial features of the dual rotor, running through a rotation cycle of operation, are best seen in FIGS. 15A–15H. Notably, FIG. 15F represents, in addition, the primary pressure, FIG. 15G represents the secondary pressure, and FIG. 15H represents the contracting part of the cycle.

Figure 17:
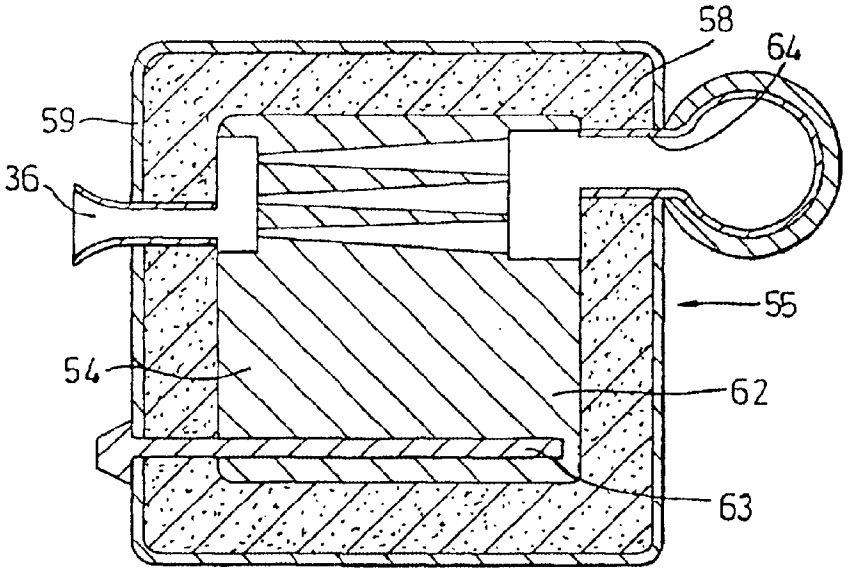
FIGS. 16–18*b* show heat cell arrangements and ancillaries, according to various aspects of the present invention.
Figure 18B:
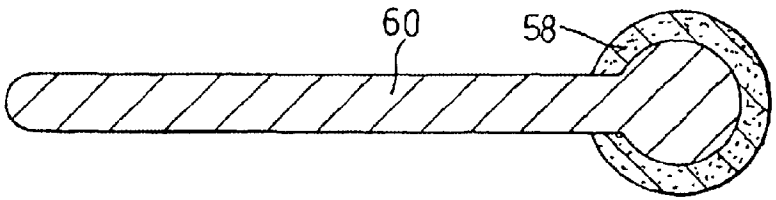
Figure 16:
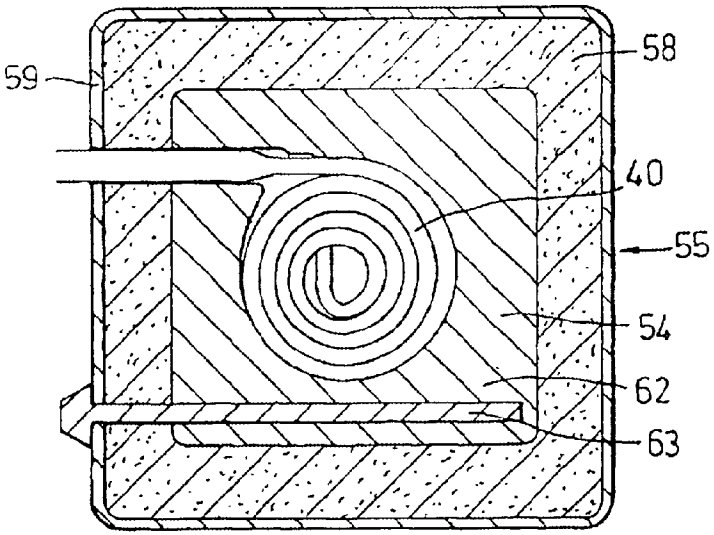
Figure 18A:
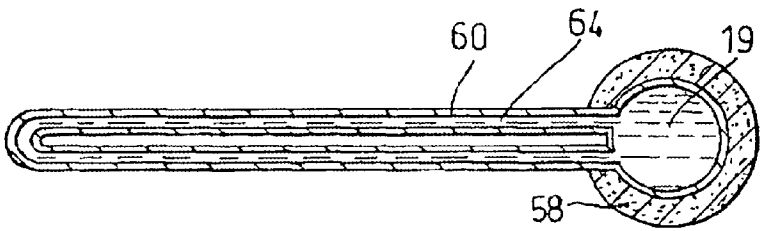

In accordance with still another aspect of the present invention, an insulated heat cell 55 is provided. More particularly, as shown in FIG. 16, the heat cell desirably includes a heat block 54 and insulation 58 encased in steel 59 with an electric heater element 63 fitted in a central cylindrical void. The void is preferably fitted with several heat exchange 40 devices, which are filled and heated using a flame (See FIG. 19B). A further heat cell arrangement is indicated in FIG. 17. Specifically, heat cell 55 is encased in steel casing 59 with internal insulation 58, an air intake 36 and a heat extraction tube 64. A heat block 62 is also included, hollowed out in the upper portion, to provide heat convection flues in order to enable heat to be extracted by passing cool air from outside through the block, which has been heated by electric heater element 63.

Figure 21:
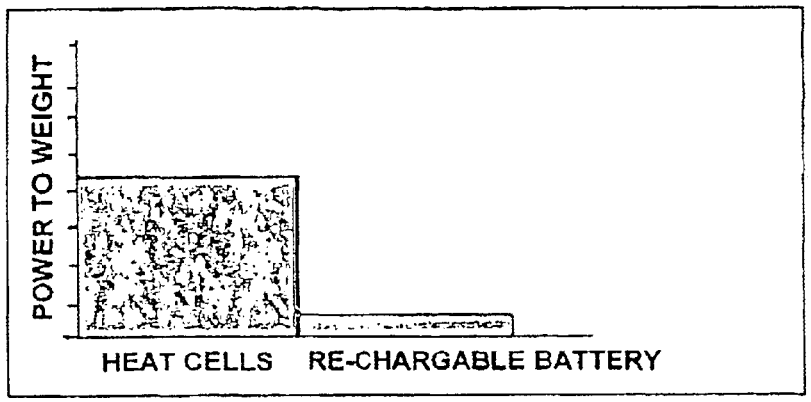
FIG. 21 is a graph comparing power to weight ratios of heat cells to those of rechargeable vehicle batteries.
Figure 22:
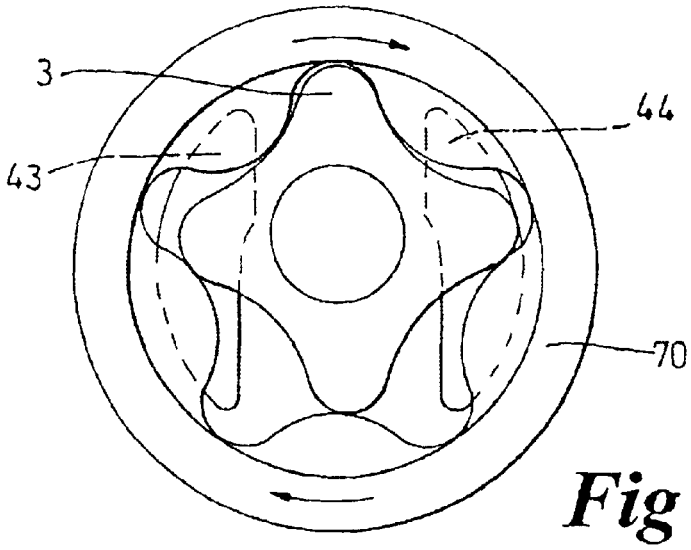
FIG. 22 shows a rotor pump, according to an alternative embodiment of the present invention.

Advantages of heat cells, according to the present invention, are demonstrated graphically in FIG. 21. More particularly, in comparing a magnetite heat cell 55 with a conventional rechargeable vehicle battery, a dramatic difference in power to weight ratios is found. Notably, the magnetite heat cell's higher energy content is shown on the left in FIG. 21, whereas the lower rechargeable vehicle battery is shown on the right.

Yet another arrangement of the present invention (see FIG. 18A) provides a lower most element 60 that is also hollow. However, in this case, extraction tube 64 is filled with a heating fluid 19, such as oil. Also, it is preferred that the heat, in this arrangement, be conveyed by flow convection or otherwise. Additionally desirable is that the bulbous portion and subsequent piping also have insulation 58, up to the point of use. Various forms of heat extraction elements 60 may be included for enabling heat to be extracted, conveyed and utilized. Each element 60 preferably has a solid profile that would conduct heat through its relatively large flat surface area and through the bulbous rod-like portion, which is made of a conductive material such as copper. Illustrative elements are shown, for instance, in FIG. 18B.

Figures 19, 19A, 19B:
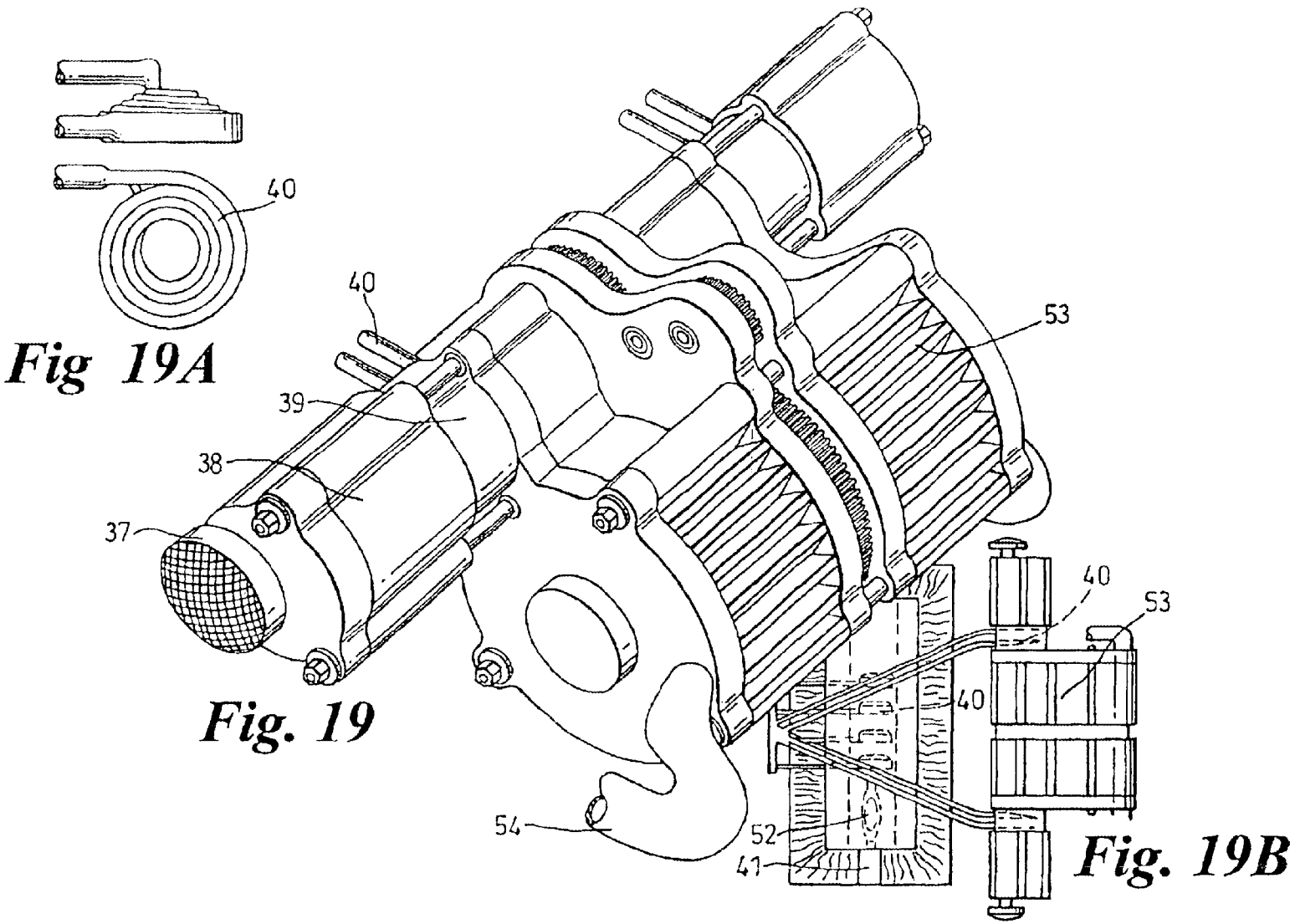
FIGS. 19A–19B are isometric views of a double expansion hot gas rotor and arrangement, according to one aspect of the present invention.
Figure 20:
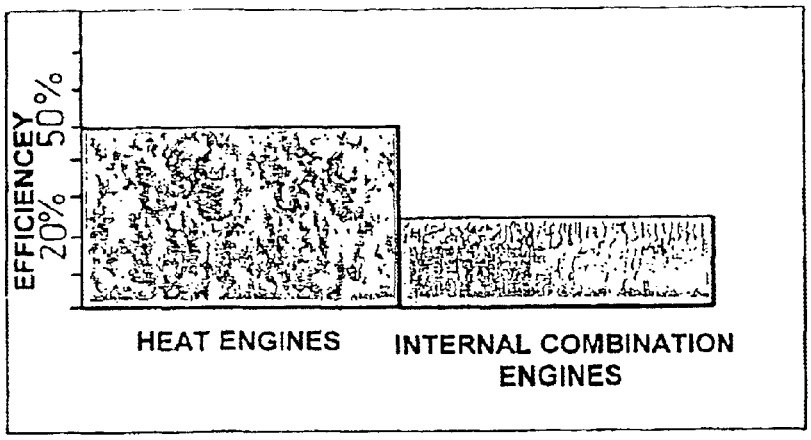
FIG. 20 is a graph comparing the efficiency of heat engines to that of internal combustion.

Turning now to hot gas applications, a hot gas rotor 53 is provided, the main component of which preferably comprises a twin bank of double expansion rotors, as shown in FIG. 19. Mounted to either side of the twin bank are two heater chambers 39 fitted internally with heat exchangers 40. Air is drawn in through air filters 37 by air compressors 38 and passed over the heat exchanger. The resulting pressurized hot air is then passed into and drives double expansion rotor 3 (See FIGS. 15–15E). The expanded and cool gases, in turn, exhaust from pipes 54 slung over either side of the twin bank. Alternatively or concurrently, as illustrated in FIG. 19A, heat exchanger 40 is a flattened tube wound into a clock spring configuration with a relatively small air space between the coils.

Another hot gas rotor arrangement 53, according to the present invention, utilizes power source in the form of a flame 52, namely, a flame charged heat cell 55. An embodiment of this general description is shown in FIG. 19B. Alternatively or concurrently, the heat cell could additionally be charged by an electrical element. The heat cell is preferably in a form such as that shown in FIG. 16, the flame 52 being generated, for example, from combustible gas or liquid fuels depending on the type of nozzle 41 used. The heat exchangers are heated by the flame. The heat exchanger tubing is desirably oil filled in order to pipe the heat to the on board heat exchangers within heater chambers 39 of the hot gas rotor. Some benefits accorded by the present invention are shown graphically in FIG. 20. In particular, the graph demonstrates a large difference between the efficiency levels of heat engines and internal combustion engines with the more efficient heat engine at 50% on the left and the internal combustion engine on the right.

Finally, according to still a further aspect of the present invention, a pump known as a gyrotor is provided. In this arrangement, illustrated in FIG. 22, rotor 3 is, for instance, four-lobed and is mounted on a shaft, meshing and rotating generally in the same direction as outer annular ring profile 70. A device is, thereby, created having four active chambers, displacing as it rotates. Ports 43, 44 are shown by a dashed line and can be rotated or rotationally distorted in the same manner as shown in FIG. 12 to vary the displacement and delivery of the pump.

Although the present invention is shown and described as suitable for use in a motor, pump or compressor, its application to driving other mechanisms is understood, giving consideration to the purpose for which the present invention is intended.

Generally speaking, according to various aspects of the present invention, three main novel devices are provided that, when combined, avail themselves as a means of mechanical propulsion for powering vehicles etc. The devices are (i) a means for heating free or pre-compressed air to power rotary heat engines, (ii) a novel rotary motor/pump design geometry, and (iii) a means for varying pump delivery by retarding ports rotationally.

Well-insulated heat cells are an established manner of storing energy, mainly charged from electricity for powering heat engines. A rotary motor/pump, according to the present invention, is a simple geometric approach that seals and moves in an efficient manner. Although applications of the present invention to heat engines and heat cells are numerous, those skilled in the art will appreciate that the novel rotor geometry, specific, illustrative embodiments of which are described herein, is at the kernel of the present invention. The rotor geometry overcomes drawbacks of existing rotary designs; namely, excessive oil requirements and rotor wear on the seals, and is not only beneficial for fluid or gas applications as a pump, compressor or motor, but also in heat or internal combustion engines.

A rotary device, according to the present invention, is advantageous in providing characteristics equivalent to those of piston rings, while offering all the benefits of rotary motion. Notwithstanding that the present invention has been shown and described herein with considerable emphasis on motor vehicle applications, primarily because of environmental concerns, those skilled in the art will appreciate its other applications, within the spirit and scope of the present invention. As for heat engine systems, a preferred method is induction and heat expansion of an air/gas mix, much the same as in power generating gas turbines which are normally closer to 50% efficiency.

Another benefit of the rotary geometry, according to the present invention, is a chamber profile that provides smooth acceleration of rotor motion. The motion can be manipulated to deliver optimum rotor lever arm characteristics dedicated to extract maximum power efficiently. Such Wankel motion, however, is known to be overly excessive and to cause acute tangential angle change between the seals and the chamber wall, which inevitably causes seal wear.

The present invention is further advantageous in retaining a smooth motion through a stable axis. The two-sided rotor desirably has two floating edge seals and seals and achieves its volume displacement by sliding through a displaced center as it rotates. The radial enlargement of the rotor's peripheral cross-section, taking up about 40% or more of the chambers full internal cross sectional area, enhances displacement, thereby enabling the displaced center off-set to be less than about 1/6th of the chamber diameter. In this regard, the rotor actually slides through the displaced center in a restrained manner, reducing the need for seal movement. The chamber is preferably of a dedicated geometry so as to maintain a virtual zero gap with the rotor. This results in a rotary device that, e.g., in ceramics, theoretically avoids the need for seals. However, even if the rotor does not follow such a dedicated peripheral geometry, the rotor itself accommodates the major sliding travel of up to about 1/3rd the effective chamber diameter with seals only traversing up to about 1/20th of the diameter distance.

Such rotor bearing restraint allows the relatively small sliding travel to be smooth and controlled in a manner of uniform acceleration and deceleration. Preferably, the sliding movement takes place through a slotted boss that is mounted in the main bearing at either end, axially upon the displaced center. The rotor movement is constrained by bearings acting on a inward set track corresponding chamber peripheral, the edge seals are effectively floating with exceptional wear life potential. The vast bulk of mechanical contact and loading is carried out through roller bearings, providing exceptional wear lift and a minimum of moving parts.

Another advantage of the present invention is that it contains all its lubricant requirements internally, i.e., its lubrication and sliding components are enclosed internally within the rotor itself. In addition, the reduced motion and travel are achieved by enhanced rotor enlargement. This means that multiple bank edge seals can be utilized without undue fluttering on acute chamber tangent angles. Additionally, the edge seals if singular, can be of significant section thickness, allowing them to act as impelling bearing surfaces that contact the chamber wall. This, in turn, allows the motion to be governed around a simple scotch crank.

The rotary motor/pump of the present invention has a highly unique overall geometry, capable of delivering compression ratios of about 2:1 up to about 15:1. In a more elaborate version, the motion is governed via a bearing set at either end within the end caps. This not only avoids high pressure wear contact on the tips of the rotor, but also causes the seals to act efficiently in that they are then isolated from the dynamic loading of the rotors. It is noted that the peripheral geometry of the chamber may be circular, part circular or fully non-circular. In the case of the later, the peripheral geometry is generally that of a dual ellipse, where the lower portion of the chamber is an ellipse split along the long axis. The upper chamber periphery is derived from and creates another half ellipse tracked from the lower, when traversed through the displaced center at a rotor's tip-to-tip distance. Such a geometry is considered ideal for driven devices such as pumps and compressors as it provides the optimum smooth rate of rotary motion.

According to a preferred arrangement, the present invention includes a two sided rotor that not only acts in a more positive manner, but also provides a degree of precise control vis-à-vis rotational portion manipulation. There are many other pump and compressor applications where variable delivery provides benefit, for instance, in a air compressor where the electrical drive motors do not run efficiently in a stop start manner. Another example is a refrigeration compressor for an conditioning unit of an automobile, where the engine speed varies and the internal cabin temperature of the automobile itself is a variance.

Within the context of the present invention, as proposed, a means is provided for resolving the problem of inefficiencies of excess delivery by incorporating port manipulation. In particular, oil pump flow rates are manipulated via a distortion or rotation of the port settings in order to advance or retard the point upon which induction and compression are enacted and, thereby, vary the effective displacement and delivery volume as required.

The preferred port manipulation takes place upon both ports. By introducing one or more plates/screens incorporating ports that can be varied rotationally to alter the point upon which displacement is enacted, the priming volume may be manipulated to back feed on itself with negligible resistance. Preferably, the rotational slide arc of such a port plate is around 80° and allows an output variance generally within a range 2.5 and 1 of delivery on a standard rotor displacement. Similar variable delivery mechanisms, in the form of adjustable plates or screens, can be provided to this and other types of rotary displacement pumps, which may be multi-lobed and chambered such as in the form of a rotary gear pump.

Where an engine/motor is being used as a driven device, the radial lever arm desirably needs to be disposed toward the extended volume portion of the chamber to accentuate and absorb the power input. In such a case, the lower periphery is somewhat parabolic in order to accelerate the rotor's radial lever arm into the upper chamber. The profile may, in fact, be partially or wholly non-symmetrical about the displaced center or, in part, follow a circular geometry for 130 degrees of angular rotation. This allows the extended radial lever arm to arc for a good period of travel.

In consideration of engine uses, the form may be used as an internal combustion engine with two or more chambers banked together with, e.g., the first pressurizing and super charging the other with an fuel air mix. Alternatively or concurrently, the two units with a right angle rotor alignment between the two-banked units. The right angle alignment provides a receptive rotor inclination, thereby, allowing instant pressure start at any rotational rest angle, as well as balanced power output.

According to a preferred version of the rotary arrangement as a heat engine, the invention has the format of a double expansion chamber powered by pre-compressed hot gas, in much the same way as a gas turbine engine. The air intake is supplemented to increase flow and operating pressure, either by rotary pump or turbo fan. One benefit of such an arrangement is that, as with gas turbines, there is a far greater power output related weight and engine volume.

An advantage in efficiency, as compared to gas turbines, is that the gas pressure output is contained and absorbed through a fully sealed chamber. This allows the pressures to be fully absorbed in a controlled and precise manner at significantly lower engine speeds than those of turbines.

Such an arrangement allows substantially more heat/pressure energy to be absorbed and utilized, exhausting far lower temperatures. It also has an inherent advantage over conventional internal combustion engines in that the power throughout is of a constant pressure flow rather than less efficient intermittent combustion firings. Conventional internal combustion engines, though balanced, lose a lot of energy associated with friction and the numerous moving parts involved. Conventional internal combustion engines also have the limitation of a few specific fuel types that are chemically suitable for compressive combustion. The present invention, on the other hand, provides efficiencies ranging from comparable to much greater than those of conventional engines.

In general, while the cleanest fuel would be hydrogen and oxygen/air, their combustion characteristics are not compatible with internal combustion. Such fuel would, however, suit the present invention. Specifically, for instance, an air heater arrangement would be provided that transfers heat from a remote main source to the pressurized airflow in order to deliver significant pressure.

By pre-compressing the heated gas to, for example, two bar, the heating effect can double the working pressure up to around four bar at temperatures of just over 520° C. This provides an active working pressure of three Bar at average global atmospheric temperatures. Even at these relatively low working temperatures/pressures, this would provide an engine unit of a lesser volume and weight than that of conventional engines. If required, the main components would be made of ceramic material or the like to operate more reliably at significantly higher temperatures. An example of the extent of power that can be derived from similar low-pressure device is the considerable output obtainable from small compressed air driven motors. In this manner, the present invention lends itself to all potential fuels (i.e., those that deliver heat energy). It is also considered to be a much more practical, versatile and powerful approach to that of alternative fuel cell technology. In terms of logistics, arrangements according to the present invention are capable of being provided in a dual fuel format, making it a viable proposition for existing fueling station infrastructure.

What is claimed is:

1. A rotary drive mechanism for use as a compressor or pump, the mechanism including: a housing having a chamber therein defined generally by a peripheral wall, the peripheral wall having a first part that is substantially semi-elliptical and defined by a first ellipse bisected along its longitudinal axis, and a second part having a geometry defined by plotting the locus of a first end of a straight line equal in length to the length of the first ellipse as a second end of the straight line moves along the first ellipse, and wherein the straight line passes through the center point of the longitudinal axis of the first ellipse; a rotor rotatably mounted in the chamber about an axis of rotation and for sliding movement relative to the axis in a direction generally perpendicular thereto, wherein the axis is offset from the center of the chamber by up to about one sixth the height of the chamber, the rotor having two longitudinal seal edges for forming seals with the peripheral wall, a cross-sectional area of at least about 30% of the cross-sectional area of the chamber, and a profile that is complementary to the first part of the chamber.

2. The mechanism set forth in claim 1, further comprising an end or mid plate having at least one of an inlet port and an outlet port formed therein.

3. The mechanism set forth in claim 2, wherein the rotor includes at least one fluid path arranged to direct fluid to the outlet port or from the inlet port respectively.

4. The mechanism set forth in claim 3, wherein the fluid path includes at least one recess formed in the rotor.

5. The mechanism set forth in claim 2, including a member for sealing the end plate or mid-plate to the chamber.

6. The mechanism set forth in claim 1, wherein the rotor is supported by bearings and the mechanism includes a bearing path having a profile substantially identical to that of the chamber peripheral wall, the arrangement being such that, in use, the rotor rotates and slides around the profile of the chamber, thereby maintaining a seal between the longitudinal seal edges and the peripheral wall of the chamber.

7. The mechanism set forth in claim 1, wherein the rotor and the chamber are arranged to achieve a compression ratio generally within a range of 2:1 and 15:1.

8. The mechanism set forth in claim 1, wherein the rotor is mounted on a shaft in a scotch crank arrangement.

9. The mechanism set forth in claim 1, wherein the rotor is non-metallic.

10. The mechanism set forth in claim 1, wherein the rotor is metallic.

11. The mechanism set forth in claim 1, wherein the chamber is non-metallic.

12. The mechanism set forth in claim 1, wherein the seal edges move less than or equal to about one twentieth of the maximum internal diameter of the peripheral wall.

13. The mechanism set forth in claim 1, wherein the rotor includes at least one undercut portion.

14. A rotary drive mechanism for use as a compressor or pump, the mechanism comprising a housing having a chamber therein defined generally by a peripheral wall wherein the peripheral wall having a first part that is substantially semi-elliptical and defined by a first ellipse bisected along a longitudinal axis, and a second part that is substantially semi-elliptical and defined by a second ellipse bisected along a lateral (narrow) axis, and an end or mid plate having at least one of an inlet port and an outlet port formed therein; a rotor rotatably mounted in the chamber about an axis of rotation and for sliding movement relative to the axis in a direction generally perpendicular thereto, wherein the axis is offset from the center of the chamber by up to about one sixth the height of the chamber, the rotor having two longitudinal seal edges for forming seals with the peripheral wall, a cross-sectional area of at least about 30% of the cross-sectional area of the chamber, and a profile that is complementary to the first part of the chamber.

15. The mechanism set forth in claim 14, wherein the rotor includes at least one fluid path for directing fluid to the outlet port or from the inlet port, respectively.

16. The mechanism set forth in claim 15, wherein the fluid path includes at least one recess formed in the rotor.

17. A pump or compressor including a rotary drive mechanism for use as a compressor or pump, the mechanism including: a housing having a chamber therein defined generally by a peripheral wall, the peripheral wall having a first part that is substantially semi-elliptical and defined by a first ellipse bisected along its longitudinal axis, and a second part having a geometry defined by plotting the locus of a first end of a straight line equal in length to the length of the first ellipse as a second end of the straight line moves along the first ellipse, and wherein the straight line passes through the center point of the longitudinal axis of the first ellipse; a rotor rotatably mounted in the chamber about an axis of rotation and for sliding movement relative to the axis in a direction generally perpendicular thereto, wherein the axis is offset from the center of the chamber by up to about one sixth the height of the chamber, the rotor having two longitudinal seal edges for forming seals with the peripheral wall, a cross-sectional area of at least about 30% of the cross-sectional area of the chamber, and a profile that is complementary to the first part of the chamber.

* * * * *